US011305548B2

(12) United States Patent
Cantrell et al.

(10) Patent No.: US 11,305,548 B2
(45) Date of Patent: Apr. 19, 2022

(54) CAP SEAL AND VALVE SEQUENCING

(71) Applicant: Hewlett-Packard Development Company, L.P., Houston, TX (US)

(72) Inventors: John J Cantrell, Vancouver, WA (US); Keith Jariabka, Vancouver, WA (US); Theodore J Conley, Vancouver, WA (US); William S Osborne, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 8 days.

(21) Appl. No.: 16/754,295

(22) PCT Filed: Oct. 20, 2017

(86) PCT No.: PCT/US2017/057746
§ 371 (c)(1),
(2) Date: Apr. 7, 2020

(87) PCT Pub. No.: WO2019/078900
PCT Pub. Date: Apr. 25, 2019

(65) Prior Publication Data

US 2020/0338898 A1 Oct. 29, 2020

(51) Int. Cl.
*B41J 2/175* (2006.01)
*B41J 29/13* (2006.01)
*B65D 43/16* (2006.01)

(52) U.S. Cl.
CPC ..... *B41J 2/17536* (2013.01); *B41J 2/1752* (2013.01); *B41J 2/17553* (2013.01); *B41J 29/13* (2013.01); *B65D 43/16* (2013.01)

(58) Field of Classification Search
CPC ..... B41J 2/17553; B41J 2/17523; B41J 2/17596; B41J 2/175; B41J 29/13; B41J 29/38; B41J 2/1752; B41J 2/17536; B65D 43/16
See application file for complete search history.

(56) References Cited

U.S. PATENT DOCUMENTS

| | | | |
|---|---|---|---|
| 4,243,150 | A | 1/1981 | Gunne et al. |
| 6,550,899 | B1 | 4/2003 | Cowger et al. |
| 6,755,500 | B2 | 6/2004 | Hirano et al. |
| 6,783,218 | B2 | 8/2004 | Cheok |
| 7,114,801 | B2 | 10/2006 | Hall et al. |
| 8,348,364 | B2 | 1/2013 | Taga |

(Continued)

*Primary Examiner* — Jannelle M Lebron
(74) *Attorney, Agent, or Firm* — Dicke Billig & Czaja PLLC

(57) ABSTRACT

An ink tank includes a cap assembly attached to the ink tank by a preloaded hinge that defines a rotational axis of the cap assembly when the cap assembly is opened and closed. The preloaded hinge biases the cap assembly to an opened position when the cap assembly is unlatched. The cap assembly includes a cap housing, a bung retained within the cap housing, a spring disposed between the cap housing and the bung, a latch to hold the cap assembly in a closed position, where in the closed position the spring applies a force to provide a seal between the bung and the ink tank. The cap assembly also includes an effector that is operative when the cap assembly is unlatched, to sequence a closing of an internal valve of the ink tank and a breaking of the seal between the bung and the ink tank thereafter.

15 Claims, 13 Drawing Sheets

(56) References Cited

U.S. PATENT DOCUMENTS

| | | | | |
|---|---|---|---|---|
| 11,046,102 | B2 * | 6/2021 | Cantrell | B41L 27/04 |
| 2003/0169318 | A1 | 9/2003 | Kline | |
| 2005/0151799 | A1 | 7/2005 | Kosciesza | |
| 2008/0231676 | A1 | 9/2008 | Shimizu | |
| 2013/0286112 | A1 | 10/2013 | O'Leary | |

* cited by examiner

CAP SEAL AND VALVE SEQUENCING

BACKGROUND

Printers are commonplace, whether in a home environment or an office environment. Such printers can include laser printer, inkjet printers or other types. Generally, printers require at least one consumable, such as paper or ink. Ink may be provided for the printers in cartridges that may be replaceable or refillable.

BRIEF DESCRIPTION OF THE DRAWINGS

For a more complete understanding of various examples, reference is now made to the following description taken in connection with the accompanying drawings in which.

DETAILED DESCRIPTION

Bubbler-style ink tanks for inkjet printers require a seal at the ink fill port during printing to create and maintain the negative back pressure required to prevent excessive ink flow due to gravity when the ink supply is located above the print head assembly. Breaking the seal to fill the ink tank may result in ink drool or flooding at the print head assembly.

To address the issues described above, various examples provide for sequencing the operation of internal and external seals of an ink tank during ink refill operations. The sequencing facilitates sealing of a valve internal to the ink tank before an external seal is broken and negative backpressure in the ink tank is lost. When a user opens an ink tank to refill the ink tank, the cap of the ink tank is automatically forced to a fully opened state by a pre-loaded hinge. In some examples, the internal valve may be actuated by opening the cap. In other examples, the cap may include a cap housing and an internal, spring-loaded bung that maintains the external seal on the ink tank while the cap housing transitions through a position that actuates the internal valve seal.

Accordingly, the present disclosure describes example apparatus, methods and systems to facilitate the sequencing of internal and external seals of ink tanks during opening and filling cycles.

In one example, an apparatus includes a cap assembly attached to an ink tank by a preloaded hinge. The hinge defines a rotational axis of the cap assembly when the cap assembly is opened and closed. The preloaded hinge biases the cap assembly to an opened position when the cap assembly is unlatched. In various examples, the cap assembly includes a cap housing and a bung retained within the cap housing. A spring is disposed between the cap housing and the bung. The cap assembly further includes a latch to hold the cap assembly in a closed position. In the closed position, the spring applies a force to provide a seal between the bung and the ink tank. An effector, operative when the cap assembly is unlatched, is provided to sequence a closing of an internal valve of the ink tank and breaking of the seal between the bung and the ink tank thereafter. An example apparatus is described below with reference to FIG. 1.

Figure 1:
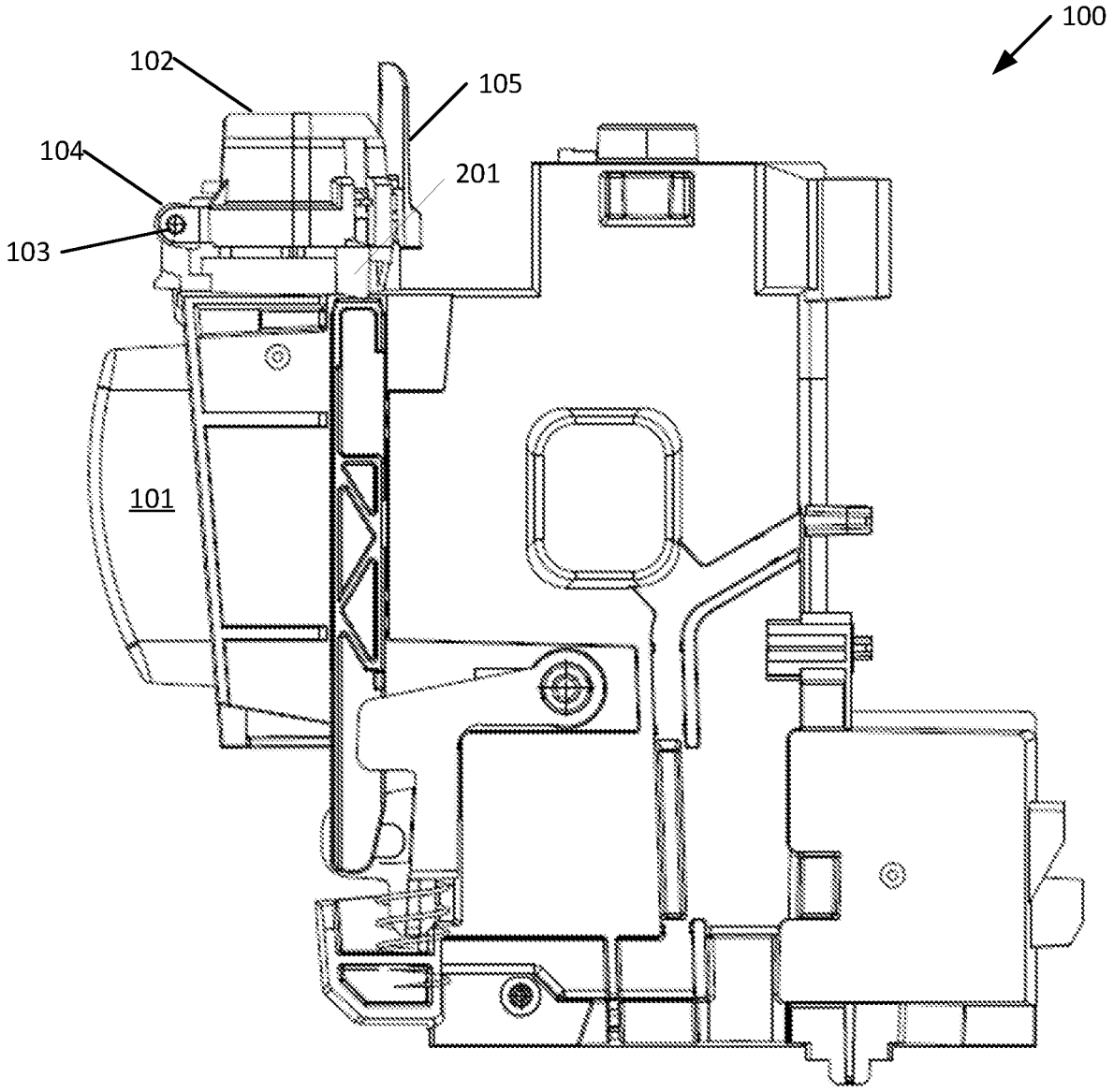
FIG. 1 is a side view of an example ink tank.

Referring now to the figures, FIG. 1 illustrates a side view of an example ink tank 100. Example ink tank 100 includes an ink tank body 101, which may be a multi-chambered ink tank as described in greater detail below. The example ink tank 100 also includes a cap assembly 102. In the example illustrated in FIG. 1, cap assembly 102 is shown in a latched (closed) state. Cap assembly 102 may be attached to the example ink tank 100 by a hinge 103.

Hinge 103 may be any type of hinge that constrains the rotation of the cap assembly 102 to a single axis of rotation. In one example, hinge 103 may be an axle engaged with cylindrical bearings extending from the cap assembly 102. In one example, hinge 103 may be preloaded with an elastic band 104 disposed around the hinge 103 to apply an opening force to the cap assembly 102, such that when the cap assembly 102 is unlatched, the opening force applied by the elastic band 104 rotates the cap assembly 102 to a fully opened position and maintains the cap assembly 102 in the fully opened position until the force is overcome by force applied by a user to close the cap assembly 102. Also illustrated in FIG. 1 is an effector 201, protruding from the cap assembly 102, which engages a spring-loaded valve linkage when the cap assembly is in the closed position. The operation of the effector and the value linkage is described in greater detail below, Example ink tank 100 also includes a latch 105 to hold the cap assembly 102 in a closed position against the opening force applied by the elastic band 104 as illustrated in FIG. 1. Accordingly, the cap assembly 102 is constrained to two stable states: a closed state (closed position) as illustrated in FIG. 1 when the latch 105 is engaged, and a fully opened state (fully opened position) when the latch is released, as described and illustrated below.

Figure 3:
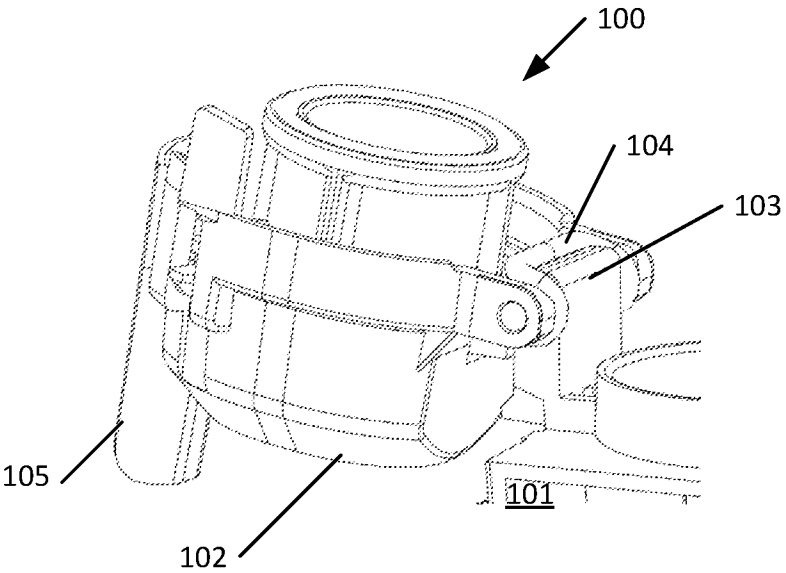
FIG. 3 is a perspective illustration of an example ink tank with an open cap.
Figure 2:
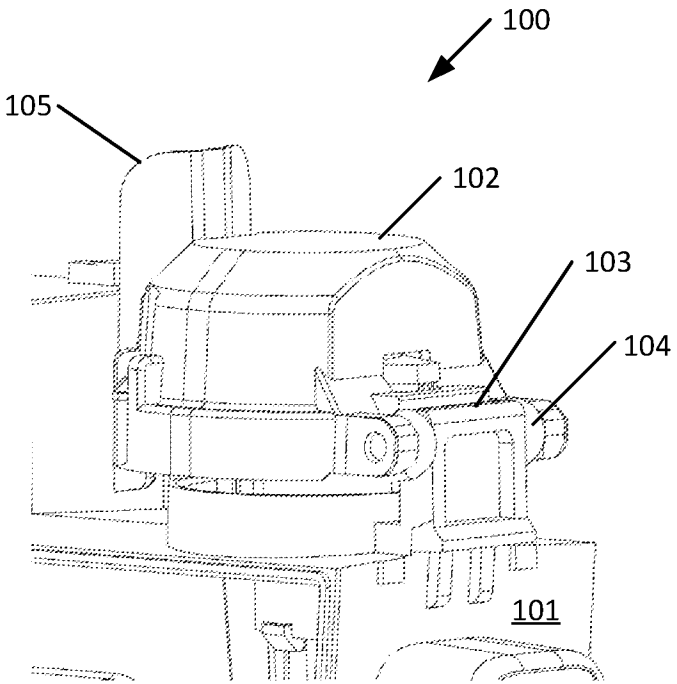
FIG. 2 is a perspective illustration of an example ink tank with a closed cap.

For greater clarity in describing the disposition and function of the elastic band 104, FIG. 2 is a perspective illustration of the ink cap assembly 102 in the closed position, and FIG. 3 is a perspective illustration of the example ink tank 100 with the cap assembly 102 in the fully opened position. It will be appreciated from these views that the elastic band 104 wraps around the ends of the axle of hinge 103 (as illustrated in FIG. 3) and under the arms of the hinge 103 (as illustrated in FIG. 3) to force to the cap assembly 102 to the fully open position as illustrated in FIG. 3.

Figure 4:
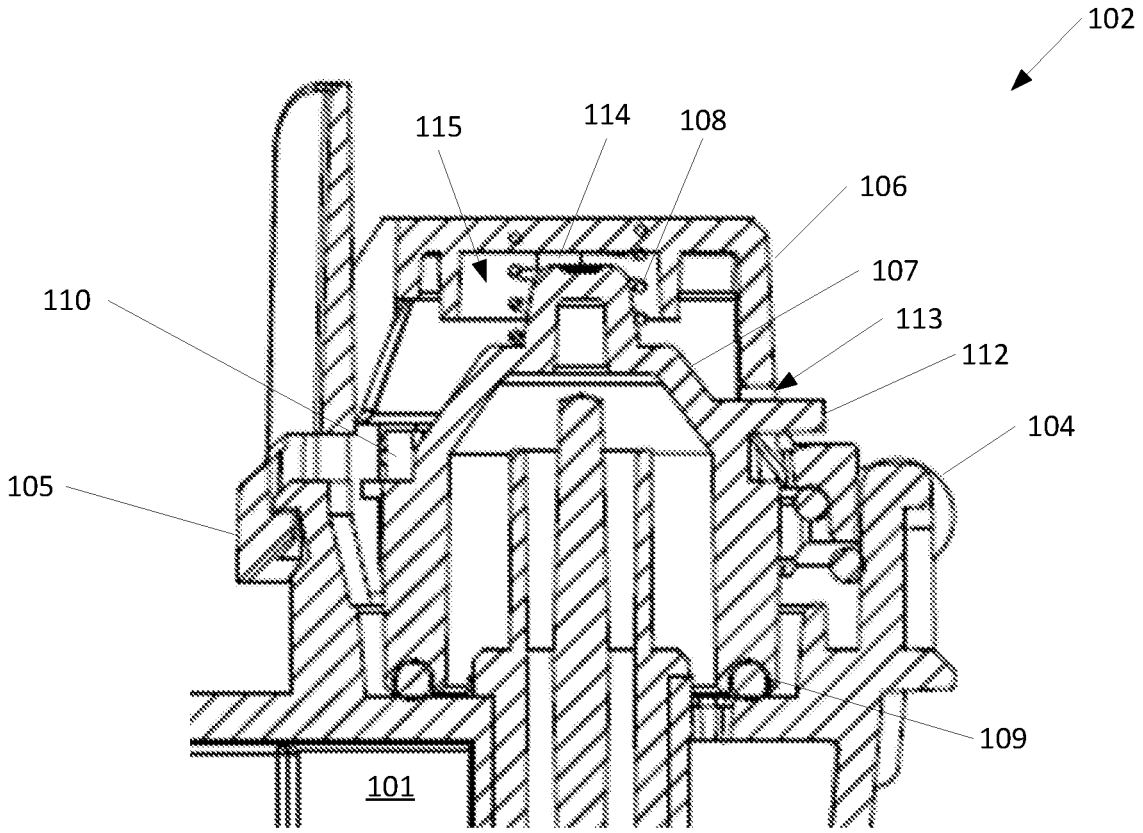
FIG. 4 is a sectional view of an example cap assembly in a closed position.
Figure 5:
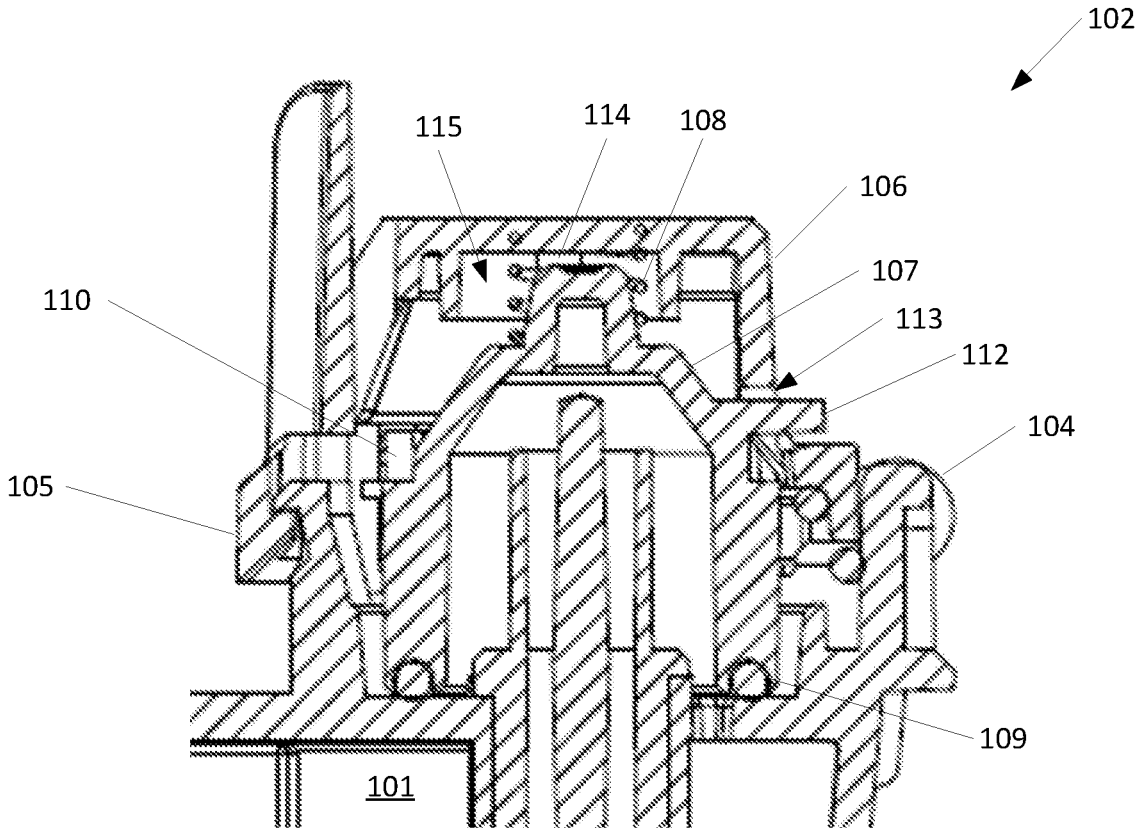
FIG. 5 is a sectional view of an example cap assembly in a partially opened position.

FIG. 4 is a sectional view of an example cap assembly 102 illustrating internal details of cap assembly 102 in the closed position, and FIG. 5 is a sectional view illustrating the cap assembly 102 of FIG. 4 in a transient, partially open state after the cap assembly 102 has been unlatched by the operation of latch 105. As illustrated in FIG. 4, the cap assembly includes a cap housing 106, a bung 107 retained within the cap housing 106, and a spring 108 disposed between the cap housing 106 and the bung 107. In one example, and without limitation, cap housing 106 may be fabricated from an acetal homopolymer thermoplastic such as Delrin,® and the bung 107 may be fabricated from a natural or synthetic elastic polymer such as natural rubber or silicone rubber. Also shown in FIG. 4 are the ink tank body 101 (partial), the elastic band 104, and the latch 105, previously described.

In the closed (latched) position illustrated in FIG. 4, the spring 108 is compressed between the cap housing 106 and the bung 107 and applies a sealing force between the bung 107 and the ink tank body 101. In one example, the bung 107 may include an O-ring 109 to improve the seal between the bung 107 and the ink tank body 101. As shown in FIG. 4, the bung 107 is retained within cap housing 106 by a number of complementary features comprising tabs or protuberances from the bung 107 and openings, cavities or channels in the cap housing 106. These include tab 110 of the bung 107 in a channel 111 of the cap housing (hidden in FIG. 4 but visible in FIG. 5), tab 112 of the bung 107 in opening 113 of the cap housing 106, and crown 114 of the bung 107 in cavity 115 of the cap housing 106. It will be appreciated that these complementary features will allow for relative motion between the cap housing 106 and the bung 107 when the cap assembly 102 is unlatched, as described below.

As noted, FIG. 5 is a sectional view illustrating the cap assembly 102 of FIG. 4 in a transient, partially open state after the cap assembly 102 has been unlatched by the operation of latch 105. This transient state is achieved by the combined forces of spring 108 and hinge 104. When latch 105 is released, spring 108 applies a force to push the cap housing 102 away from the bung 107 while maintaining a sealing force between the bung 107 and the ink tank body 101. It will be appreciated that this force decreases as spring 108 decompresses and that the relative motion of the cap housing 106 and the bung 107 is limited by the complementary features of the cap assembly 106 and the bung 107 described above.

In the transient state shown in FIG. 5, tab 112 is constrained by opening 113, the crown 114 (with spring 108) has moved within cavity 115, and tab 110 has reached the lower bound of channel 111, which limits further relative motion between the cap housing 106 and the bung 107. In one example, described in greater detail below, this transient position serves to actuate a valve in the ink tank (using other features of the cap housing 102) to effect a secondary seal in the ink tank body 101 before the seal between the bung 107 and the ink tank body 101 is broken. After the cap assembly 102 reaches the transient position illustrated in FIG. 5, further motion of the cap assembly 102 is controlled by the force applied to the cap assembly 102 by the elastic band 104. As described previously, this force rotates the cap assembly to a fully open position.

Figure 6:
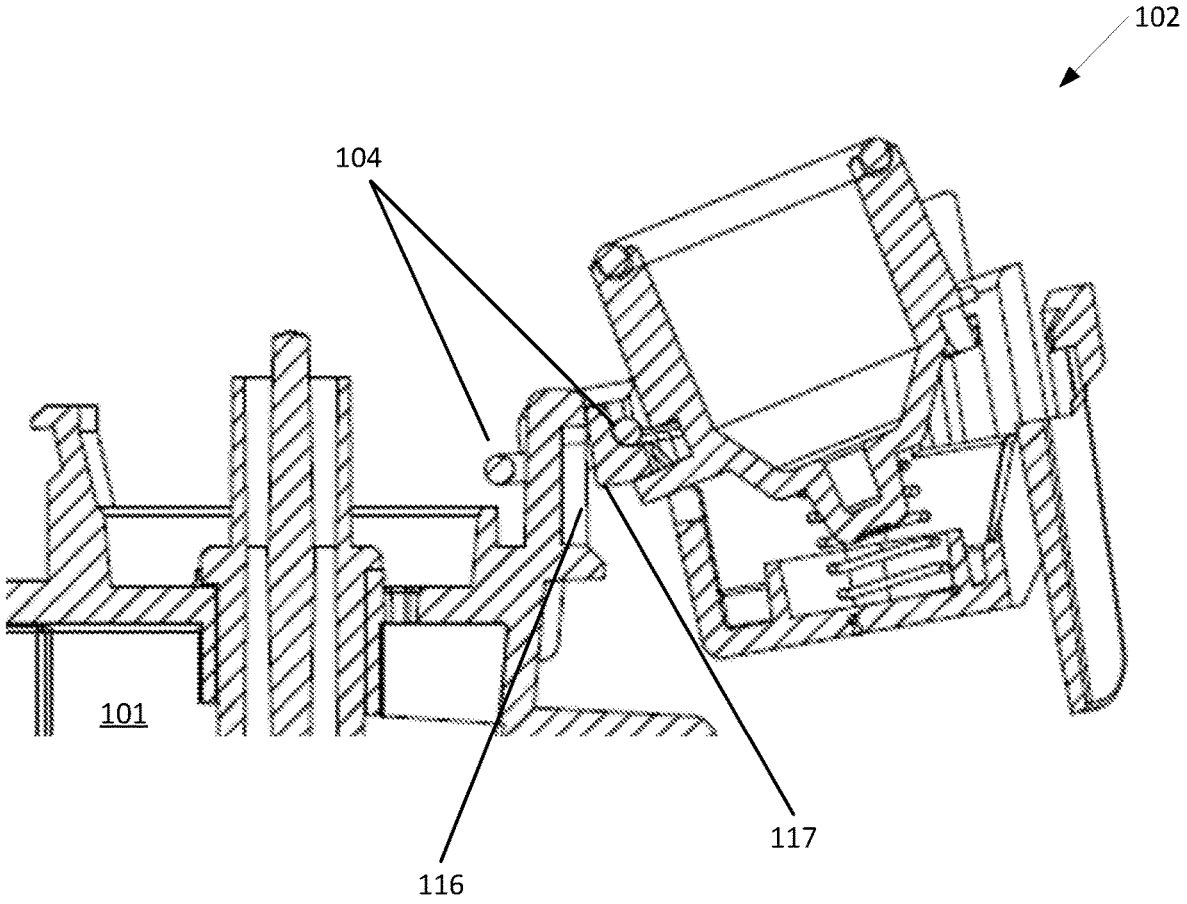
FIG. 6 is a sectional view of an example cap assembly in a fully opened position.

FIG. 6 is a sectional view illustrating the cap assembly 102 of FIGS. 4 and 5 in the fully open state. In this state, further rotation is limited by interference between a sidewall 116 of the ink tank body 101 and a flange 117 of the hinge 103 (not visible in FIG. 6).

Figure 7:
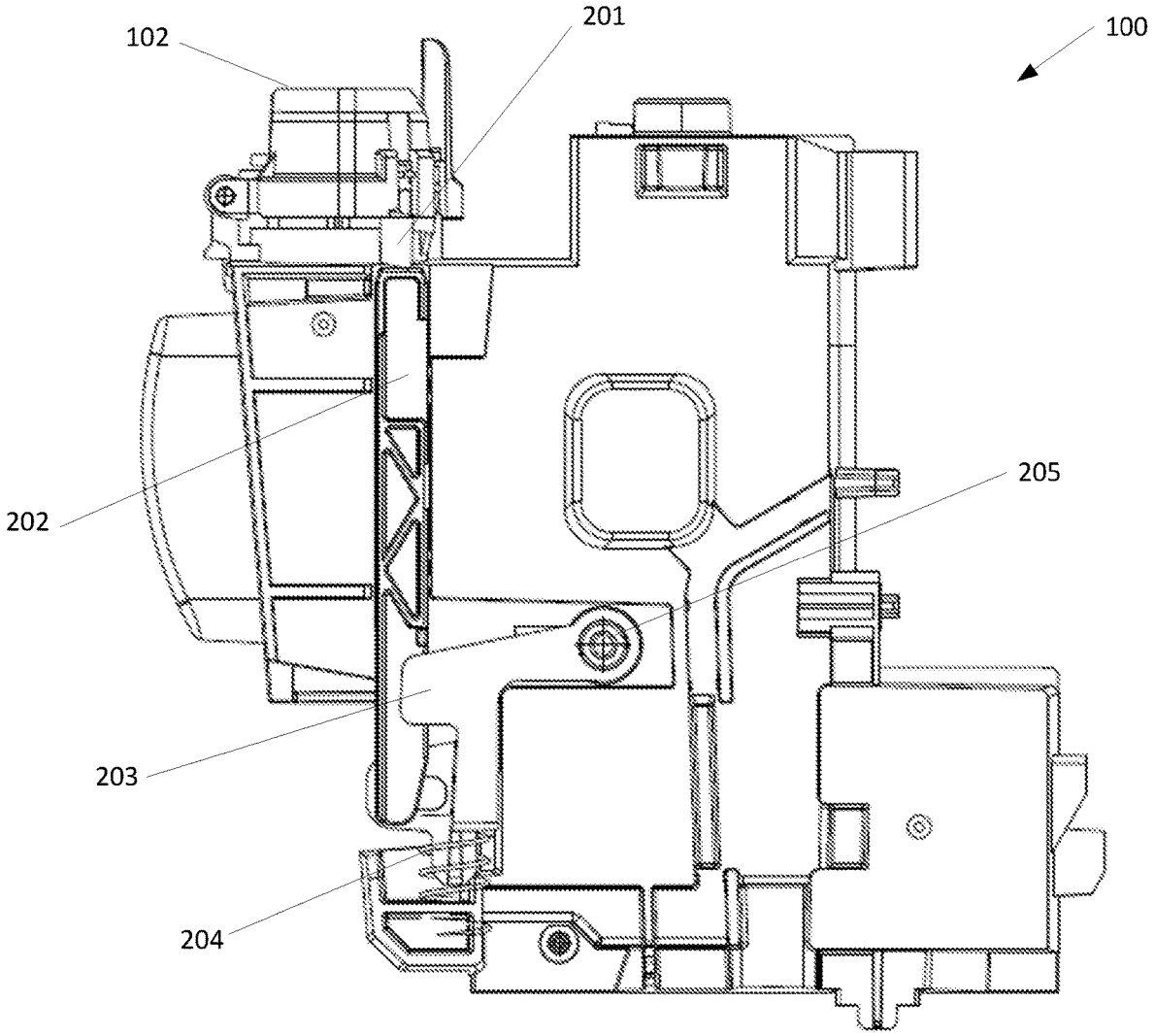
FIG. 7 is a side view of an example ink tank.

Turning now to a description of the secondary sealing mechanism referenced above with respect to the opening of the cap assembly 102, FIG. 7 illustrates the side view of the example ink tank 100 previously illustrated in FIG. 1. In the example of FIG. 7, the cap assembly 102 is in the closed (latched) state. In this state, an effector 201 (an extension of cap assembly 102) extends downward from the cap assembly 102 to depress a slider 202, which is retained in a channel in the body of the ink tank 100. The slider may be retained by any means known in the art, such as by channels or tabs, for example. In this position, the slider 202 is engaged with a cam on lever arm 203 that is spring loaded by a spring 204, and holds the lever arm 203 in a downward position against the force of the spring 204. Lever arm 203 is fixed to a rotatable spline 205 that extends into the interior of the ink tank body 101. In one example, spline 205 may be held in place by a snap-ring or c-clip, and sealed by an O-ring or the like as it passes through the wall of the ink tank body 101.

Figure 8:
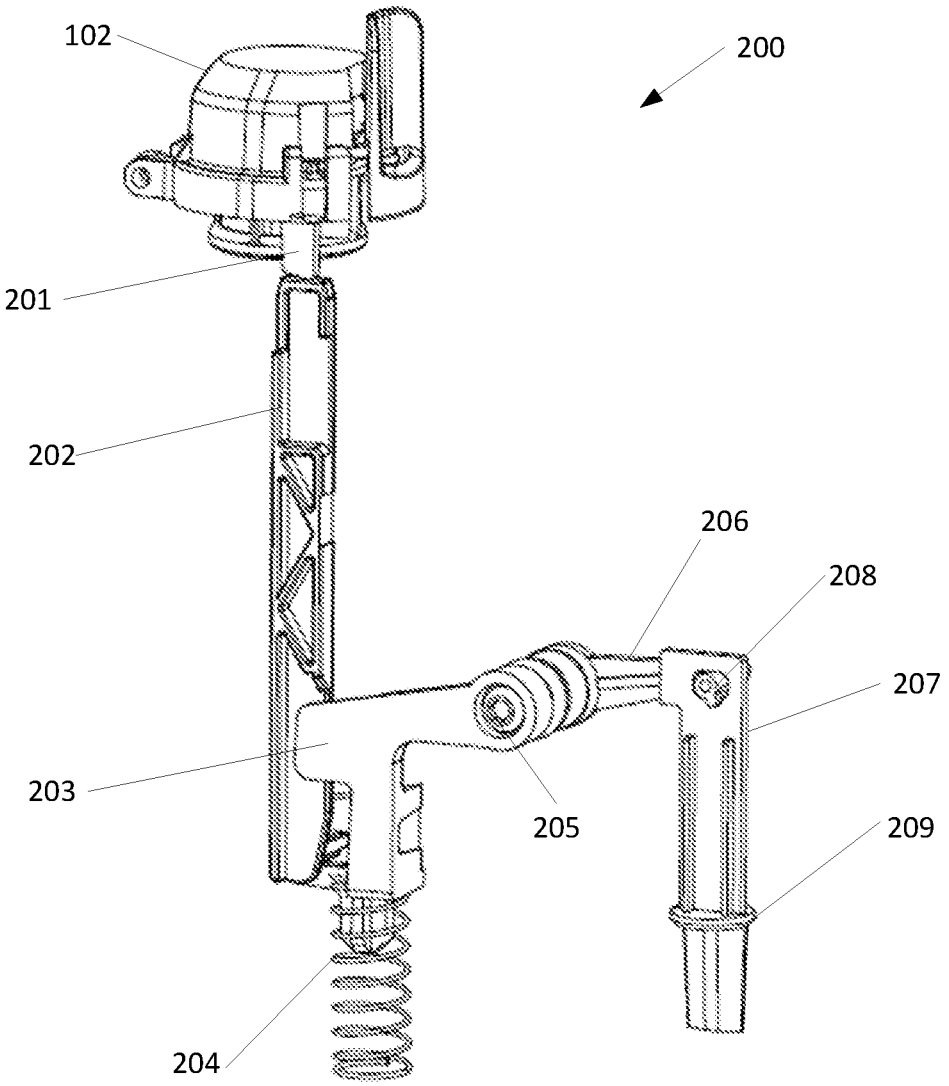
FIG. 8 is a perspective illustration of an example valve linkage.

FIG. 8 is a perspective illustration of the linkage described above, in isolation, showing additional details not visible in FIG. 7. In FIG. 8, the sealed pinion 205 is fixed to a second lever arm 206, which in turn is connected to a valve body 207 by a pin 208 that is fixed with respect to lever arm 206 and free to rotate with respect to valve body 207. Valve body 207 includes a valve seal 209 that is configured to provide a seal when seated in a valve seat 210 in the ink tank (see FIG. 9). It will be appreciated that in the closed cap configurations illustrated in FIG. 7 and FIG. 8, the lever arm 203 is held in a downward rotated position by the slider 202, that lever arm 206 is held in an upward rotated position by its fixed connection to lever arm 203 via spline 205, and that the valve assembly comprising valve seal 209 and valve seat 210 is held open.

Figure 9:
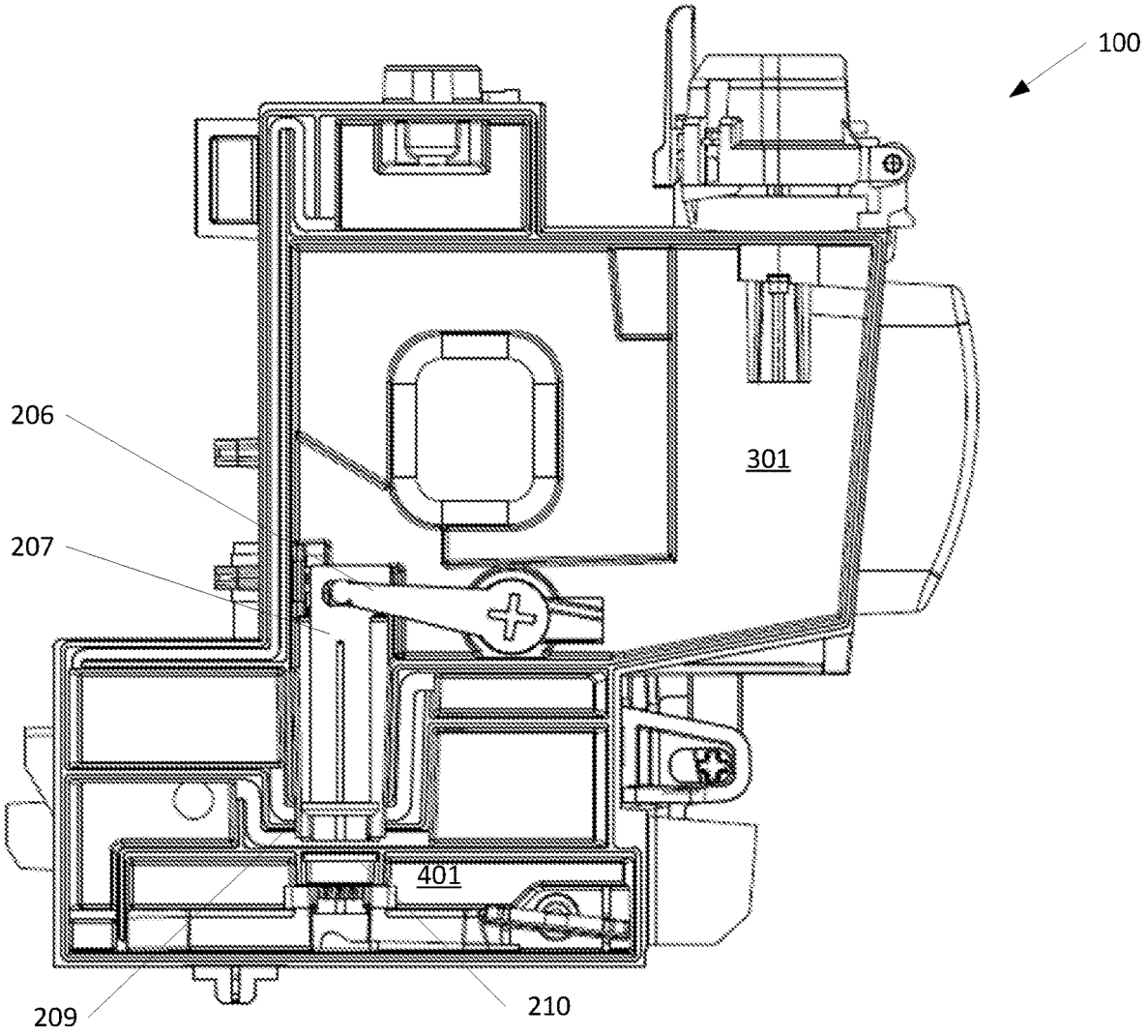
FIG. 9 is a sectional view of an example ink tank with a closed cap.

FIG. 9 is a partial sectional (cutaway) view of the example ink tank 100, showing internal details of the ink tank and the valve linkage described above in the closed cap configuration. In FIG. 9, lever arm 206 is in its upward rotated position, which translates through valve body 207 to an unseated valve seal 209. Also illustrated in FIG. 9 is an upper chamber 301 of ink tank body 101, and a lower chamber 401 of ink tank body 101, also referred to as a feeder tank. The valve assembly is positioned between the upper chamber 301 and the lower chamber 401 and permits fluid commination between the upper chamber 301 and the lower chamber 401.

Figure 10:
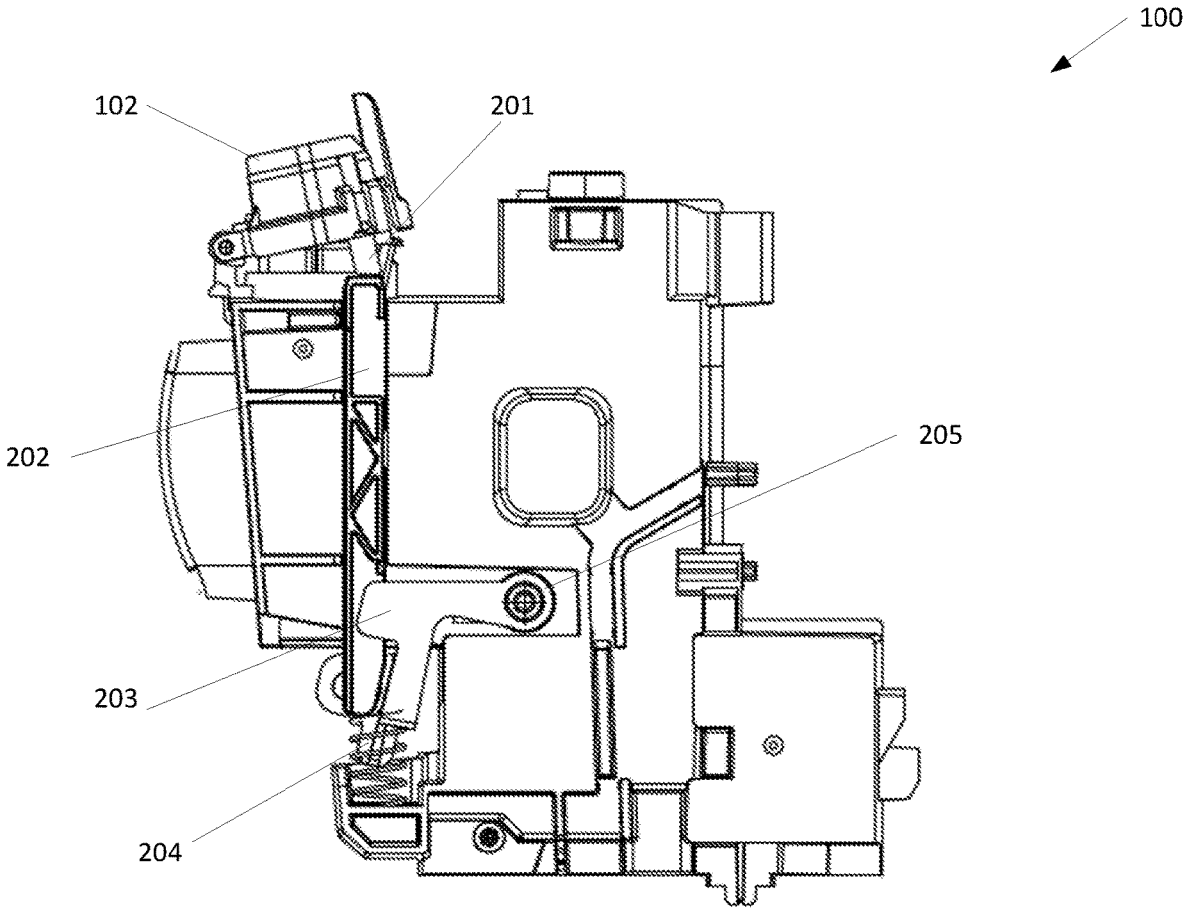
FIG. 10 is a side view of an example ink tank with a partially open cap.

Turning now to FIG. 10, there is illustrated a side view of the example ink tank 100 with the cap in the transient, partially open state described above. In this transient state, the cap assembly 102 is partially open, such that the cap housing 106 is partially rotated and the bung (107) to ink tank (101) seal is maintained, but the holding force applied by effector 201 is removed from slider 202, which allows the force of spring 204 to rotate lever arm 203 upward (clockwise in FIG. 10). In one example, the angle of rotation of the cap assembly 102 relative to the closed position may be in the range of approximately 10 to 14 degrees.

Figure 11:
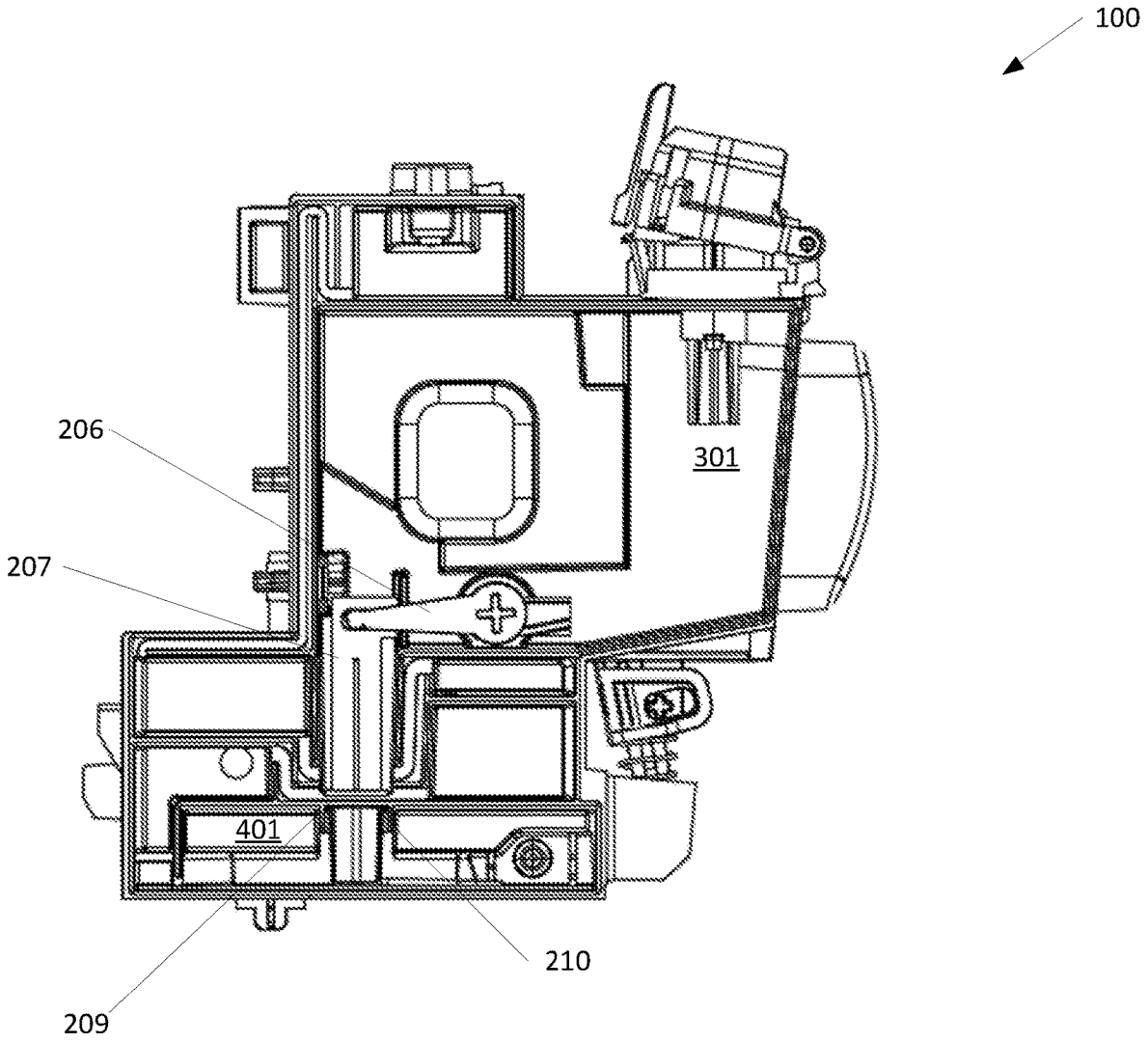
FIG. 11 is a sectional view of an example ink tank with a partially open cap.

FIG. 11 is a partial sectional (cutaway) view of the example ink tank 100, showing internal details of the ink tank and the valve linkage described above in the transient, partially open cap state. In FIG. 11, lever arm 206 is rotated downward, which translates through valve body 207 to seat valve seal 209 into value seat 210, thereby providing a seal between upper chamber 301 and lower chamber 401 and preventing fluid communication between the upper chamber 301 and the lower chamber 401.

Figure 12:
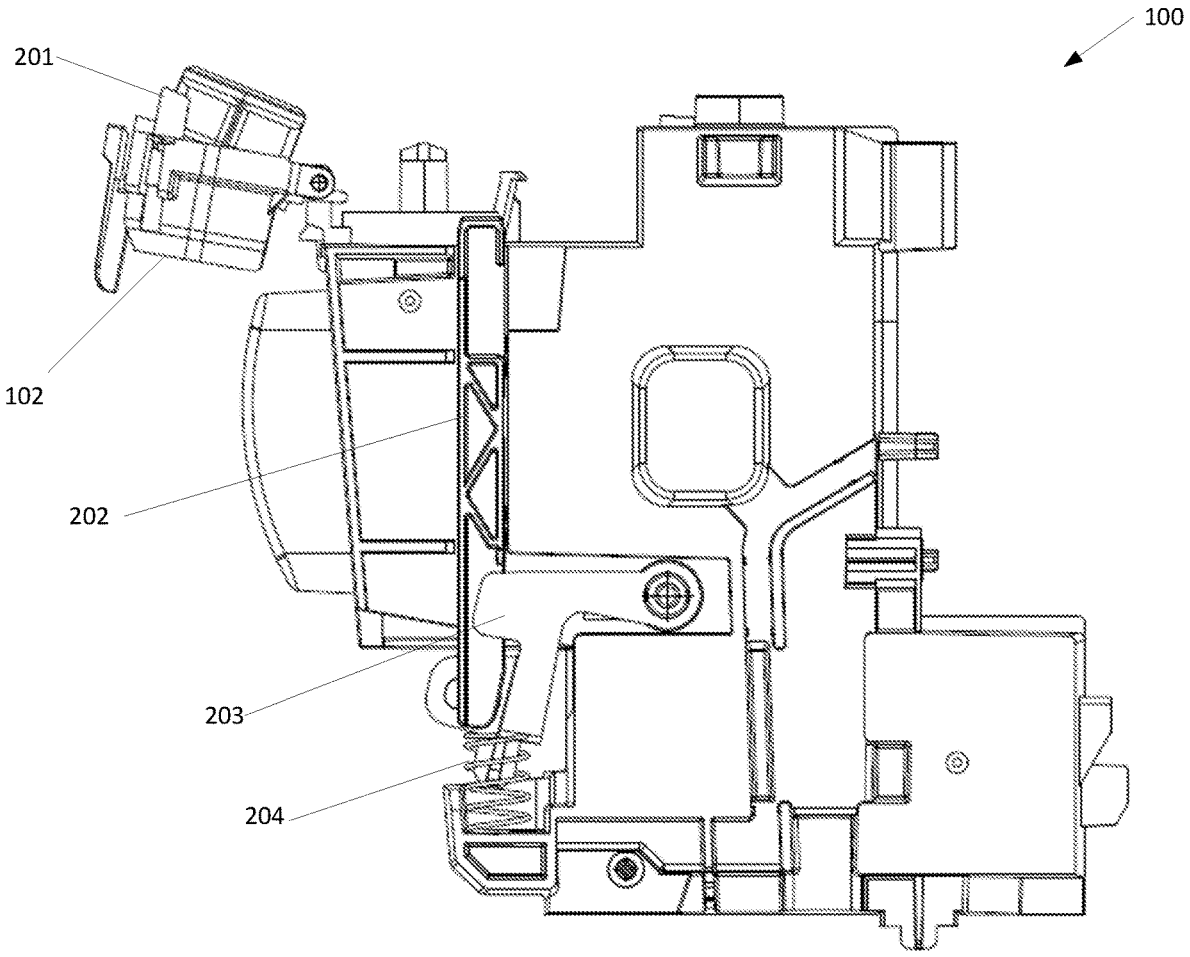
FIG. 12 is a side view of an example ink tank with a fully opened cap.

FIG. 12 illustrates the example ink tank 100 with the cap assembly rotated to its fully opened position under the force applied by the elastic band 104 described above. It will be appreciated that the internal seal between valve seal 209 and valve seat 210 will be maintained as the cap assembly 102 rotates from the transient position to the fully opened position because the effector 201 remains disengaged from the slider 202, allowing the spring 204 to hold the lever arm 203 in its upward rotated position. As described above, this position of lever arm 203 corresponds to the seating of valve seal 209 in valve seat 210.

The seal between the upper chamber 301 and the lower chamber 401 isolates the upper chamber to prevent gravitationally induced pressure from causing ink drool at the print head assembly.

From the foregoing description, it will be appreciated that the sequence of events that occurs when the cap is opened is reversible when the cap assembly 102 is closed by a user. Between the fully opened state and the transient state, the internal valve is closed and the upper chamber 301 of ink tank body 101 is not sealed by the bung 107. When the cap assembly reaches the transient position, the bung (107) seals the upper chamber 301 of ink tank (101) and the effector 201 engages the slider 202. From the transient position to the closed position, the effector 201 depresses slider 202, which rotates lever arm 203 downward and lever arm 206 upward to unseat valve seal 209 from valve seat 210, reestablishing fluid communication between upper chamber 301 of ink tank body 101 and lower chamber 401 of ink tank body 101.

Figure 13:
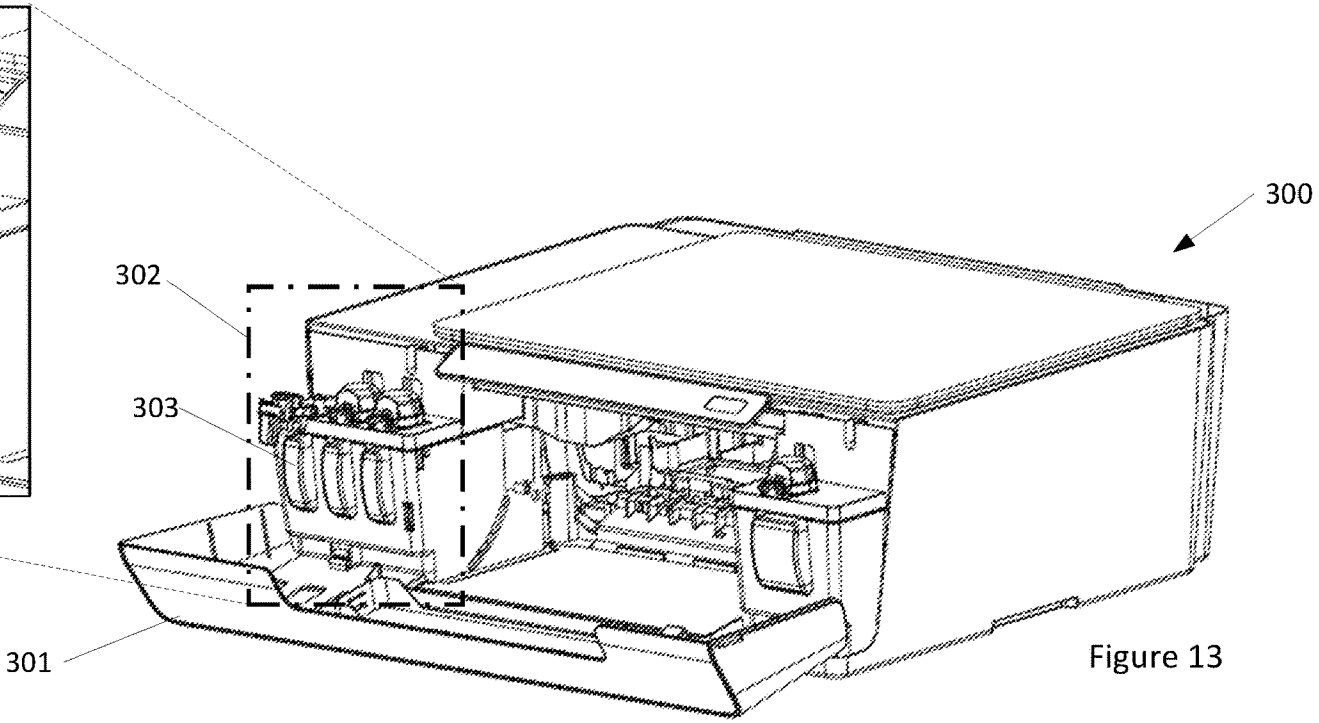
FIG. 13 is a perspective illustration of an example printing system.
Figure 14:
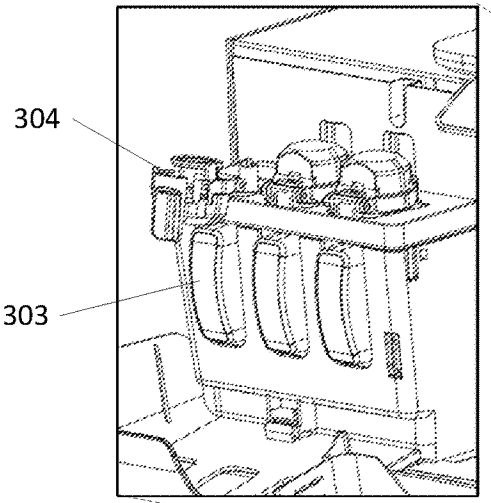
FIG. 14 is a magnified view of an example ink tank bay in the printing system illustrated in FIG. 13.

FIG. 13 illustrates an example printer system 300 with an access door 301 in an open position to allow access to an ink tank bay 302 containing at least one ink tank, such as example ink tank 303, for filling or refilling. FIG. 14 is a magnified view of the ink tank bay 302 illustrating one of the example ink tanks 303 and a cap assembly 304 in a fully opened position. The example ink tank 303 and the cap assembly 304 may be similar to the example ink tank 100 and cap assembly 102 described above with reference to FIGS. 1-12. In this regard, each ink tank 303 in the ink tank bay 302 includes a cap assembly, such as cap assembly 304, attached to the ink tank 303 by a preloaded hinge. The cap assembly 304 includes a cap housing and a bung retained within the cap housing. A spring is disposed between the cap housing and the bung. An elastic band is provided to pre-load the hinge to apply an opening force to the cap assembly 304. The cap assembly 304 includes a latch to hold the cap assembly 304 in a closed position. In the closed position, the spring applies a force to provide a seal between the bung and the ink tank. An effector, operative when the cap assembly 304 is unlatched, is provided to sequence a closing of an internal valve of the ink tank 303 and a breaking of the seal between the bung and the ink tank 303 thereafter.

Figure 15:
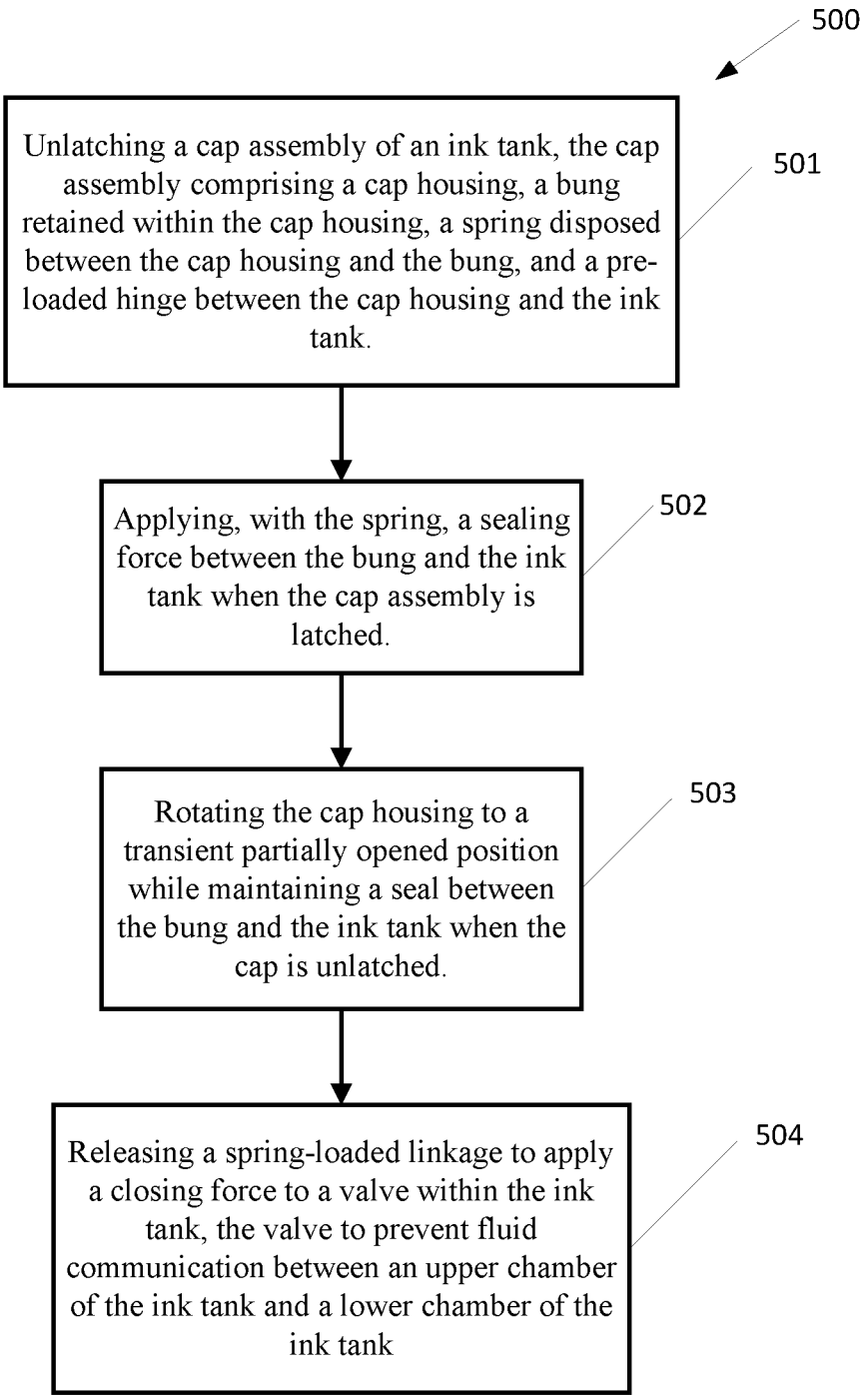
FIG. 15 is a flowchart illustrating an example method for sequencing internal and external seals.

Referring now to FIG. 15, a flowchart illustrates an example method 500 for sequencing internal and external seals of an ink tank. The example method includes unlatching a cap assembly of an ink tank, such as cap assembly 102 of example ink tank 100, where the cap assembly comprises a cap housing such as cap housing 106, a bung retained within the cap housing such as bung 107, a spring disposed between the cap housing and the bung, such as spring 108, and a pre-loaded hinge between the cap housing and the ink tank such as hinge 103 (block 501). Example method 500 further includes applying a sealing force between the bung and the ink tank with the spring when the cap assembly is latched, for example by latch 105 (block 502). Example method 500 also includes rotating the cap housing to a transient partially opened position (e.g., as illustrated in FIGS. 5, 10, and 11) while maintaining a seal between the bung and the ink tank when the cap is unlatched, as illustrated in FIG. 5 (block 503). Finally, the example method 500 includes releasing a spring-loaded linkage (such as the linkage illustrated in FIG. 8, for example) to apply a closing force to a valve within the ink tank (e.g., valve seal 209), where the valve prevents fluid communication between an upper chamber of the ink tank and a lower chamber of the ink tank, such as chambers 301 and 401 illustrated in FIG. 11.

Thus, in accordance with various examples described herein, sequencing the operation of internal and external seals of an ink tank during ink refill operations insures that a valve internal to the ink tank is sealed before an external seal is broken and negative backpressure in the ink tank is lost. When a user opens an ink tank to refill the ink tank, the cap of the ink tank is automatically forced to a fully opened state by a pre-loaded hinge.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described to explain the principles and the nature of various examples of the present disclosure and its practical application to enable one skilled in the art to use the present disclosure in various examples and with various modifications as are suited to the particular use contemplated. The features of the examples described herein may be combined in all possible combinations of methods, apparatus and systems.

It is also noted herein that while the above describes examples, these descriptions should not be viewed in a limiting sense. Rather, there are several variations and modifications which may be made without departing from the scope as defined in the appended claims.

What is claimed is:

1. An apparatus, comprising:

a cap assembly rotatably attached to an ink tank by a preloaded hinge, the preloaded hinge defining a rotational axis of the cap assembly when the cap assembly is opened and closed, the preloaded hinge to bias the cap assembly to an opened position when the cap assembly is unlatched, the cap assembly comprising:

a cap housing;

a bung rotatably retained within the cap housing, the bung to provide a seal with the ink tank;

a spring disposed between the cap housing and the bung;

a latch to hold the cap assembly in a closed position, wherein in the closed position the spring applies a force to the bung to provide the seal between the bung and the ink tank; and an effector extended from the cap assembly, operative when the cap assembly is unlatched and rotated to a fully opened position, to sequence a closing of an internal valve of the ink tank and a breaking of the seal between the bung and the ink tank thereafter.

2. The apparatus of claim 1, wherein the ink tank comprises an upper chamber and a lower chamber and the internal valve therebetween, the apparatus further comprising:

a spring-loaded linkage, engaged with the effector when the cap assembly is latched, to hold open the internal valve, wherein the upper chamber is in fluid communication with the lower chamber;

the spring-loaded linkage, disengaged with the effector when the cap assembly is unlatched, to apply a closing force to the internal valve when the cap assembly is opened, wherein fluid communication between the upper chamber and the lower chamber is prevented.

3. The apparatus of claim 2, wherein the pre-loaded hinge and the spring are operative to force the cap housing to a transient partially opened position while maintaining the seal between the bung and the ink tank when the cap assembly is unlatched.

4. The apparatus of claim 3, wherein when the cap housing is in the transient partially opened position, the effector is disengaged with the spring-loaded linkage, wherein the valve is closed and fluid communication between the upper chamber and the lower chamber is prevented.

5. The apparatus of claim 4, wherein the pre-loaded hinge is operative to rotate the cap assembly from the transient partially opened position to the fully opened position, wherein the seal between the bung and the ink tank is broken.

6. A method, comprising:

unlatching a cap assembly of an ink tank, the cap assembly rotatably attached to the ink tank and comprising a cap housing, a bung rotatably retained within the cap housing, a spring disposed between the cap housing and the bung, and a pre-loaded hinge between the cap housing and the ink tank;

applying, with the spring, a sealing force to the bung to provide a seal between the bung and the ink tank when the cap assembly is latched;

rotating the cap housing to a transient partially opened position while maintaining the seal between the bung and the ink tank when the cap assembly is unlatched; and sequencing a closing of an internal valve of the ink tank and a breaking of the seal between the bung and the ink tank after the closing of the internal valve when the cap assembly is unlatched and rotated to a fully opened position.

7. The method of claim 6, with the cap housing in the transient partially opened position, further comprising;

applying, with the pre-loaded hinge, a rotating force to the cap assembly; and rotating the cap assembly to the fully opened position, wherein the seal between the bung and the ink tank is broken.

8. The method of claim 7, further comprising:

filling the ink tank; and closing and latching the cap assembly.

9. The method of claim 8, wherein closing the cap assembly comprises sealing the ink tank with the bung.

10. The method of claim 8, wherein latching the cap assembly comprises engaging the spring-loaded linkage to apply an opening force to the valve to establish fluid communication between the upper chamber of the ink tank and the lower chamber of the ink tank.

11. A system, comprising:

an ink tank bay;

at least one ink tank installed in the ink tank bay, each ink tank comprising a cap assembly rotatably attached to the ink tank by a preloaded hinge, wherein the cap assembly comprises:

a cap housing;

a bung rotatably retained within the cap housing, the bung to provide a seal with the ink tank;

a spring disposed between the cap housing and the bung;

an elastic band to pre-load the hinge to apply an opening force to the cap assembly;

a latch to hold the cap assembly in a closed position, wherein in the closed position the spring applies a force to the bung to provide the seal between the bung and the ink tank; and an effector extended from the cap assembly, operative when the cap assembly is unlatched and rotated to a fully opened position, to sequence a closing of an internal valve of the ink tank and a breaking of the seal between the bung and the ink tank thereafter.

12. The system of claim 11, wherein the ink tank comprises an upper chamber and a lower chamber and a valve therebetween, the system further comprising:

a spring-loaded linkage, engaged with the effector when the cap assembly is latched, to hold open the internal valve, wherein the upper chamber is in fluid communication with the lower chamber;

the spring-loaded linkage, disengaged with the effector when the cap assembly is unlatched, to apply a closing force to the internal valve when the cap assembly is opened, wherein fluid communication between the upper chamber and the lower chamber is prevented.

13. The system of claim 12, wherein the spring and the pre-loaded hinge are operative to force the cap housing to a transient partially opened position while maintaining the seal between the bung and the ink tank when the cap assembly is unlatched.

14. The system of claim 13, wherein when the cap housing is in the transient partially opened position, the effector is disengaged with the spring-loaded linkage, wherein the valve is closed and fluid communication between the upper chamber and the lower chamber is prevented.

15. The system of claim 14, wherein the pre-loaded hinge is operative to rotate the cap assembly to the fully opened position, wherein the seal between the bung and the ink tank is broken.

* * * * *